US009159258B2

(12) United States Patent
Lee

(10) Patent No.: US 9,159,258 B2
(45) Date of Patent: Oct. 13, 2015

(54) DISPLAY DEVICE, AND OPTICAL COMPENSATION SYSTEM AND OPTICAL COMPENSATION METHOD THEREOF

(71) Applicant: SAMSUNG DISPLAY CO., LTD., Yongin, Gyeonggi-Do (KR)

(72) Inventor: Gil-Jae Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 178 days.

(21) Appl. No.: 13/917,609

(22) Filed: Jun. 13, 2013

(65) Prior Publication Data

US 2014/0184671 A1 Jul. 3, 2014

(30) Foreign Application Priority Data

Dec. 28, 2012 (KR) ..... 10-2012-0157328

(51) Int. Cl.
*G09G 3/00* (2006.01)

(52) U.S. Cl.
CPC ..... *G09G 3/006* (2013.01); *G09G 2330/10* (2013.01)

(58) Field of Classification Search
CPC ..... G09G 3/006; G09G 2330/10
See application file for complete search history.

(56) References Cited

U.S. PATENT DOCUMENTS

| | | | | |
|---|---|---|---|---|
| 7,868,857 | B2 | 1/2011 | Nathan et al. | |
| 2004/0120014 | A1* | 6/2004 | Nakajima et al. | 382/263 |
| 2005/0237318 | A1 | 10/2005 | Inoue et al. | |
| 2007/0229420 | A1* | 10/2007 | Hwang | 345/87 |
| 2008/0309602 | A1* | 12/2008 | Hwang | 345/89 |
| 2011/0243475 | A1* | 10/2011 | Hayakawa et al. | 382/286 |

FOREIGN PATENT DOCUMENTS

| | | | |
|---|---|---|---|
| JP | 2005-316408 | A | 11/2005 |
| JP | 2011-39451 | A | 2/2011 |
| KR | 10-2005-0052064 | | 6/2005 |
| KR | 10-2008-0007254 | | 1/2008 |
| KR | 10-2010-0047064 | | 5/2010 |

* cited by examiner

*Primary Examiner* — Allison Johnson
(74) *Attorney, Agent, or Firm* — Christie, Parker & Hale, LLP

(57) ABSTRACT

A display device, and an optical compensation system and an optical compensation method thereof. A display device including a display panel including pixels; and a display driving circuit for driving the display panel and including: a storage unit for storing defect pixel information indicating which of the pixels are detected as defect pixels based on a brightness trend line of the pixels, and for storing compensation parameters regarding the defect pixels; and a brightness compensation unit for converting image data corresponding to the defect pixels according to the defect pixel information and the compensation parameters.

18 Claims, 14 Drawing Sheets

DISPLAY DEVICE, AND OPTICAL COMPENSATION SYSTEM AND OPTICAL COMPENSATION METHOD THEREOF

CROSS-REFERENCE TO RELATED PATENT APPLICATION

This application claims priority to and the benefit of Korean Patent Application No. 10-2012-0157328, filed on Dec. 28, 2012, in the Korean Intellectual Property Office, the disclosure of which is incorporated herein in its entirety by reference.

BACKGROUND

1. Field

Aspects of the present invention relate to a display device, and an optical compensation system and an optical compensation method thereof.

2. Description of the Related Art

Currently, various flat panel display devices having small weights and volumes, unlike cathode ray tube (CRT) devices, are being produced. Examples of these flat panel display devices include a liquid crystal display (LCD) device, a plasma display panel (PDP), and an organic light emitting diode (OLED).

Flat panel display devices may have a mura defect. A mura defect refers to a stain generated due to an error or a defect generated in a process of manufacturing a panel, and causes non-uniform brightness characteristics on a whole surface or a partial region of the panel. According to a particular cause of the mura defect, the mura defect may have a typical shape such as a dot, line, strip, circle, or polygon, or may have an atypical shape. The mura defect may be generated due to defect pixels having brightness deviations greater than those of the other pixels.

SUMMARY

Embodiments of the present invention provide a display device for compensating optical characteristics by detecting a region having a mura defect, and an optical compensation system and an optical compensation method thereof.

According to an aspect of the present invention, there is provided a display device including: a display panel including a plurality of pixels; and a display driving circuit for driving the display panel and including: a storage unit for storing defect pixel information indicating which pixels from among the plurality of pixels are detected as defect pixels based on a brightness trend line of the plurality of pixels, and for storing compensation parameters regarding the defect pixels; and a brightness compensation unit for converting image data corresponding to the defect pixels according to the defect pixel information and the compensation parameters.

A defect pixel of the defect pixels may be a pixel in which a difference between a measured brightness value of the pixel and a brightness value of a location corresponding to the pixel on the brightness trend line is greater than a critical value.

The brightness trend line may have a form of an Nth order function (where N is an integer equal to or greater than 1) calculated based on a distribution of brightness data of the plurality of pixels, which are obtained by measuring the display panel.

The storage unit may be configured to store the compensation parameters according to an order in which corresponding defect pixels are located.

The compensation parameters may include brightness compensation data corresponding to the defect pixels, individually.

The brightness compensation unit may be configured to determine whether or not each of the plurality of pixels is one of the defect pixels based on the defect pixel information, and to convert the image data corresponding to the defect pixels by applying the compensation parameters according to an order in which the compensation parameters are stored.

The defect pixel information may include indices representing whether or not the plurality of pixels is one of the defect pixels, individually.

The defect pixel information may include an index code in which first indices indicating the defect pixels and second indices indicating non-defect pixels of the pixels are sequentially aligned according to locations of corresponding pixels.

According to one embodiment, the index code is compressed based on repeated numbers of the same indices. In the index code, a smaller bit may be allocated to a more frequently repeated number of the same indices.

According to an aspect of the present invention, there is provided an optical compensation system for preventing non-uniform brightness values of a display panel, the optical compensation system including: the display panel for displaying an image; an imaging unit for capturing the image displayed on the display panel; a defect pixel detection unit for generating a brightness trend line of the display panel by analyzing brightness data obtained by using the image captured by the imaging unit, and for detecting defect pixels based on the brightness trend line; and a compensation parameter generation unit for generating compensation parameters for compensating for brightness values of the defect pixels.

The brightness trend line may have a form of an Nth order function (where N is an integer equal to or greater than 1) on a first axis indicating one direction on the display panel and a second axis indicating brightness values.

The defect pixel detection unit may be configured to calculate the brightness trend line based on the brightness data of pixels located on a same line of the display panel.

The defect pixel detection unit may be configured to calculate the brightness trend line having a ratio of the defect pixels to a total number of pixels that is equal to or less than a predetermined ratio.

According to an aspect of the present invention, there is provided an optical compensation method including: obtaining brightness data of a display panel including a plurality of pixels; determining a brightness trend line of the display panel according to a distribution of the brightness data; determining defect pixels of the plurality of pixels and compensation parameters based on the brightness trend line; and storing defect pixel information and the compensation parameters in a storage unit of a display driving circuit.

The determining of the defect pixels and the compensation parameters may include detecting a pixel of the plurality of pixels as one of the defect pixels if a difference between a measured brightness value of the pixel and a brightness value of a location corresponding to the pixel on the brightness trend line is greater than a critical value.

The determining of the defect pixels and the compensation parameters may include generating the compensation parameters based on a difference between measured brightness values of the defect pixels and brightness values of locations corresponding to the defect pixels on the brightness trend line.

The determining of the brightness trend line may include: modeling the distribution of the brightness data to a form of an Nth order function (where N is an integer equal to or greater than 1); and determining an appropriateness of the form of the Nth order function based on a ratio of the defect pixels to a total number of the plurality of pixels before determining it as the brightness trend line.

The storing of the defect pixel information and the compensation parameters may include: providing pixel indices individually representing whether the plurality of pixels are defect pixels; and generating the defect pixel information based on the pixel indices individually provided to the plurality of pixels.

The method may further include converting image data to be displayed on the display panel and corresponding to the defect pixels according to the defect pixel information and the compensation parameters.

BRIEF DESCRIPTION OF THE DRAWINGS

The above and other features and aspects of the present invention will become more apparent by describing in detail exemplary embodiments thereof with reference to the attached drawings in which.

DETAILED DESCRIPTION

Figure 1:
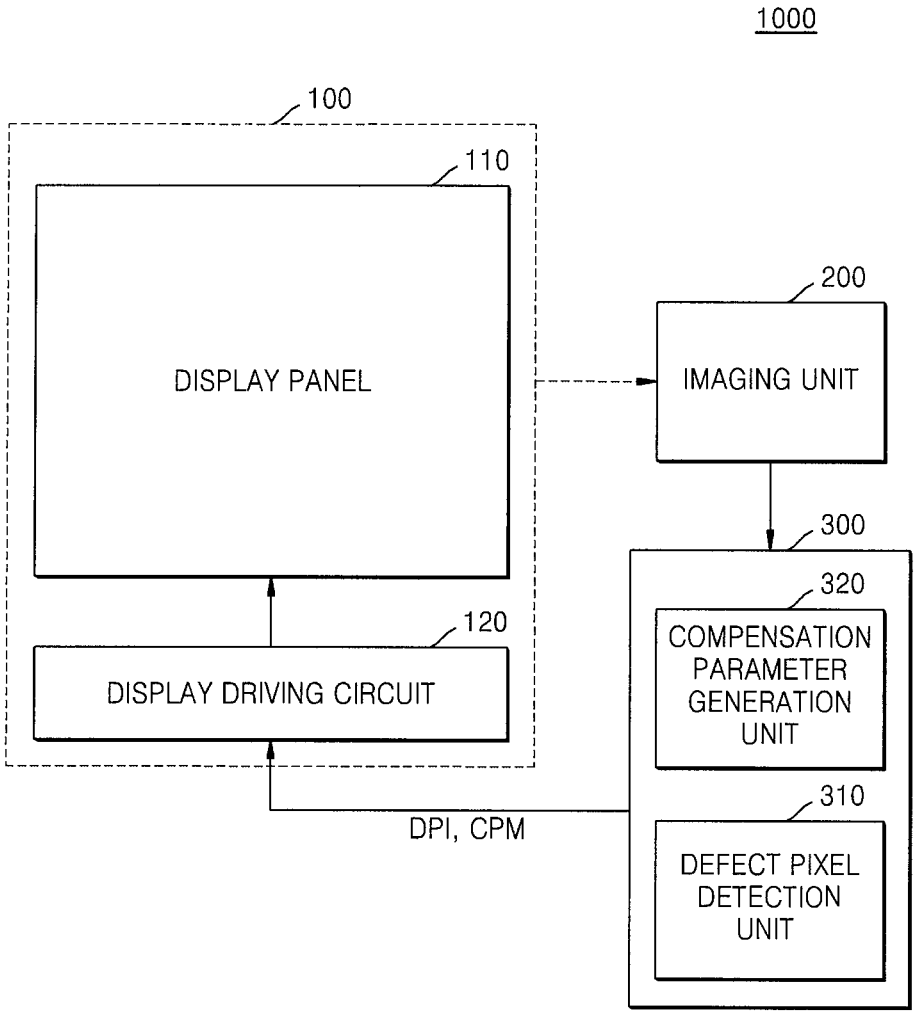
FIG. 1 is a block diagram of an optical compensation system according to an embodiment of the present invention.

While exemplary embodiments of the invention are susceptible to various modifications and alternative forms, specific embodiments are shown by way of example in the drawings and will herein be described in detail. It should be understood, however, that there is no intent to limit embodiments of the invention to the particular forms disclosed, but conversely, embodiments of the invention are intended to cover all modifications, equivalents, and alternatives falling within the spirit and scope of the invention. In the following description, a detailed description of functions and configurations incorporated herein will be omitted when it may make the subject matter of the present invention unclear.

It will be understood that, although the terms first, second, etc. may be used herein to describe various elements, these elements should not be limited by these terms. These terms are only used to distinguish one element from another.

The terminology used herein is for the purpose of describing particular embodiments only and is not intended to be limiting of exemplary embodiments of the invention. As used herein, the singular forms "a", "an" and "the" are intended to include the plural forms as well, unless the context clearly indicates otherwise. It will be further understood that the terms "comprises", "comprising," "includes", and/or "including", when used herein, specify the presence of stated features, integers, steps, operations, elements, and/or components, but do not preclude the presence or addition of one or more other features, integers, steps, operations, elements, components, and/or groups thereof.

Hereinafter, aspects of the present invention will be described in detail by explaining embodiments of the invention with reference to the attached drawings.

FIG. 1 is a block diagram of an optical compensation system 1000 according to an embodiment of the present invention.

Referring to FIG. 1, the optical compensation system 1000 may include a display device 100, an imaging unit 200, and a compensation data generation unit 300.

The display device 100 may include a display panel 110 for displaying an image, and a display driving circuit 120 for driving the display panel 110.

The display device 100 may be one of various types of flat panel display devices. For example, the flat panel display devices may be a liquid crystal display (LCD) device, a plasma display panel (PDP), an organic light emitting diode (OLED) display, an electrochromic display (ECD) device, a digital mirror device (DMD), an actuated mirror device (AMD), a grating light value (GLV) device, or an electroluminescent display (ELD) device.

Figure 2A:
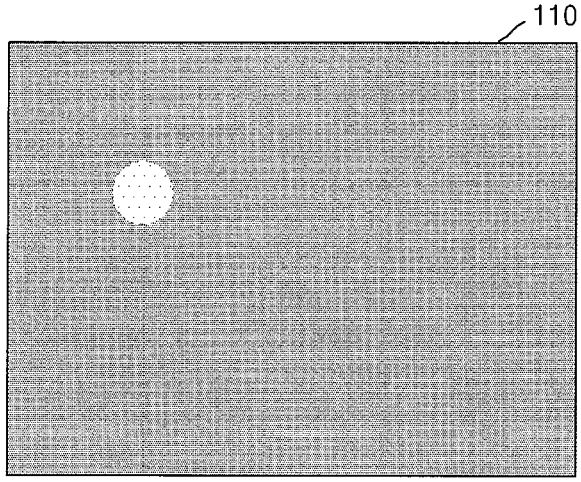
FIGS. 2A and 2B are diagrams showing examples of a mura defect.
Figure 2B:
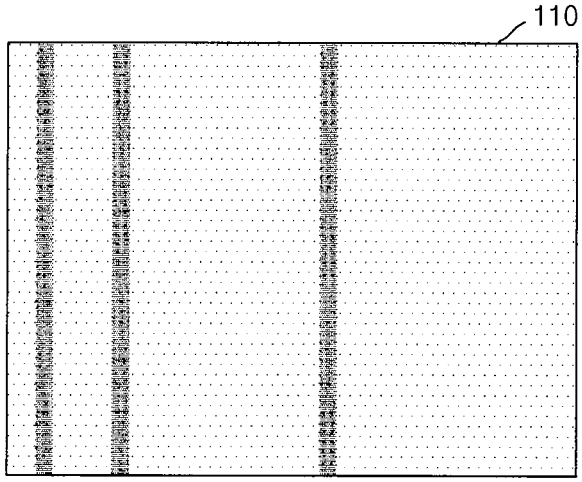

As illustrated in FIGS. 2A and 2B, the display panel 110 may have a mura defect. FIG. 2A is a diagram showing a circular mura defect, and FIG. 2B is a diagram showing a linear mura defect. Referring to FIG. 2A, a mura defect having a form of a circle may be generated because a top left region of the display panel 110 has a brightness value higher than that of other regions. Referring to FIG. 2B, a mura defect having a form of three lines may be generated because some column-direction regions of the display panel 110 have a brightness value lower than that of other regions. In general, a mura defect may be generated if a partial region of the display panel 110 has a brightness value different from that of other regions. Depending on a cause of the mura defect, the mura defect may have a typical shape such as a dot, line, strip, circle, or polygon, or may have an atypical shape. The mura defect may be generated because defect pixels having brightness deviations greater than those of the other pixels are generated due to an error or a defect generated in a manufacturing process.

The optical compensation system 1000 according to the current embodiment may prevent generation of a mura defect by optically compensating for the defect pixels. The imaging unit 200 may capture the image of the display panel 110 displaying a uniform grayscale, and the compensation data generation unit 300 may generate compensation data, for example, DPI and CPM, based on brightness data of the display panel 110, which is obtained by using the captured image, and may provide the compensation data, such as, defect pixel information (DPI) and compensation parameters (CPM), to the display driving circuit 120. The compensation data DPI and CPM may be stored in the display driving circuit 120. The display driving circuit 120 may prevent (or inhibit or reduce) the occurrence of a mura defect on the image displayed on the display panel 110 by compensating for brightness values of the defect pixels based on the compensation data DPI and CPM.

The imaging unit 200 may capture the image displayed on the display panel 110. The imaging unit 200 may include, for example, a camera, scanner, optical sensor, or spectroscope. Although the imaging unit 200 is located outside the display device 100 in FIG. 1, the current embodiment is not limited thereto; for example, the imaging unit 200 may be included in the display device 100.

The compensation data generation unit 300 may include a defect pixel detection unit 310 and a compensation parameter generation unit 320.

The defect pixel detection unit 310 may generate a brightness trend line of the display panel 110 by analyzing the brightness data obtained by using the image captured by the imaging unit 200, and may detect the defect pixels based on the brightness trend line. In one embodiment, the brightness trend line is obtained by modeling the brightness data of the display panel 110 in an appropriate function. For example, the brightness trend line may have the form of an Nth-order function (where N is an integer equal to or greater than 1) according to a distribution of the brightness data. The brightness trend line, according to embodiments of the present invention, may have the form of, for example, a linear, quadratic, or cubic function on an axis of one direction on the display panel 110 and an axis of brightness values.

According to one embodiment, the distribution of the brightness data is modeled to the forms of linear, quadratic, and cubic functions, and then the form of the most appropriate function may be determined (or selected) as the brightness trend line. For example, the form of a function that is the closest to the distribution of the brightness data may be determined as the brightness trend line, or the form of an appropriate function based on at least one of short range uniformity (SRU) and long range uniformity (LRU) may be determined as the brightness trend line. In this case, the brightness trend line may be calculated based on the brightness data of pixels located on the same line, column, or row of the display panel 110, or may be calculated based on the brightness data of all pixels included in the display panel 110.

After the brightness trend line is determined, a brightness difference in a visually unrecognizable range from the brightness trend line is set as a critical value. If a difference between a measured brightness value of a pixel and a brightness value of a location corresponding to the pixel on the brightness trend line is greater than the critical value, the pixel may be detected as a defect pixel.

Information regarding the defect pixels may be indexed and may be generated as defect pixel information DPI. For example, the defect pixel information DPI may include indices individually representing whether a plurality of pixels have defects. The defect pixel information DPI may be compressed by using various coding methods.

The compensation parameter generation unit 320 generates compensation parameters CPM regarding the defect pixels detected by the defect pixel detection unit 310, according to one embodiment. The compensation parameters CPM may be data for compensating for brightness values of the defect pixels to be similar to those of locations corresponding to the defect pixels on the brightness trend line. The compensation parameters CPM may be brightness compensation data individually corresponding to the defect pixels.

The compensation data generation unit 300 may provide the generated defect pixel information DPI and the compensation parameters CPM to the display device 100. The defect pixel information DPI and the compensation parameters CPM may be stored in a storage unit of the display driving circuit 120.

When the display panel 110 is driven, the display driving circuit 120 may determine the defect pixels based on the defect pixel information DPI, and may perform data conversion, for example, by applying the compensation parameters CPM to image data, which is to be displayed on the display panel 110 and corresponds to the defect pixels.

As described above, by detecting defect pixels based on a brightness trend line according to a distribution of measured brightness data, the optical compensation system 1000 according to the current embodiment may apply detection criteria more flexibly in comparison to a case where defect pixels are detected simply based on an average value or absolute values of brightness data.

A mura defect may be more noticeable when a brightness difference between adjacent pixels, rather than far pixels, is large. Accordingly, by detecting pixels having brightness differences outside a visually unrecognizable range based on a brightness trend line in consideration of the distribution of the of brightness data, as defect pixels, the defect pixels may be efficiently detected according to brightness characteristics of the display panel 110.

According to one embodiment, by indexing the defect pixel information DPI and applying the compensation parameters CPM only to defect pixels, the optical compensation system 1000 may reduce the capacity of a storage region (e.g., non-volatile memory) for storing the defect pixel information DPI and the compensation parameters CPM in the display driving circuit 120, and may reduce power consumption of the display device 100.

Figure 3:
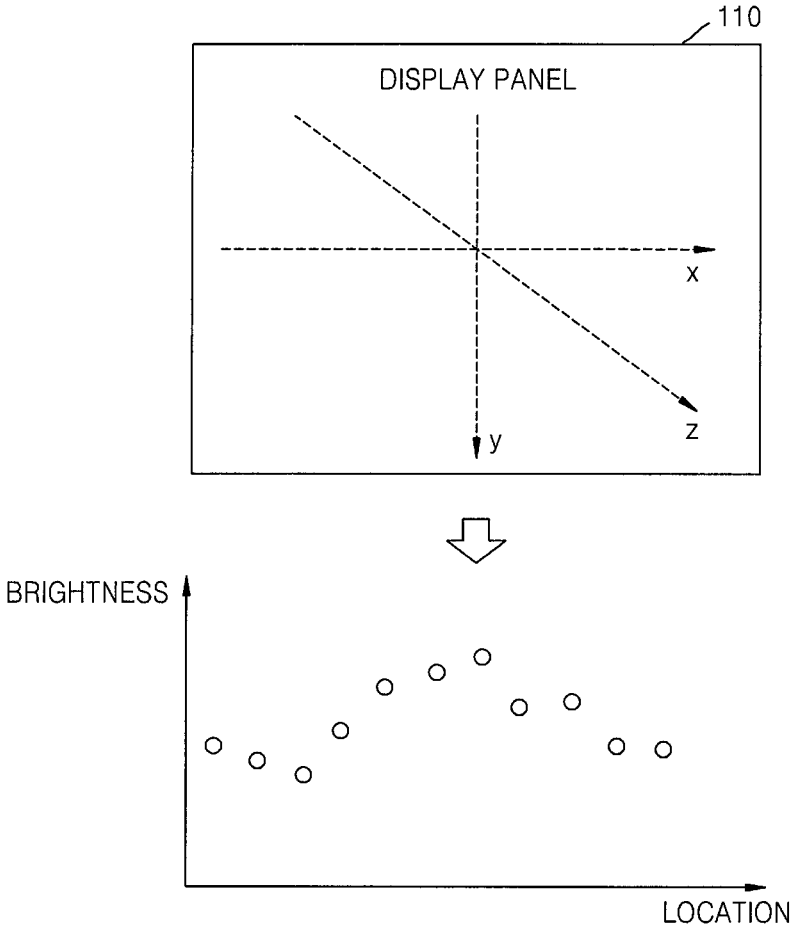
FIG. 3 is a diagram showing a distribution of brightness data.
Figure 4A:
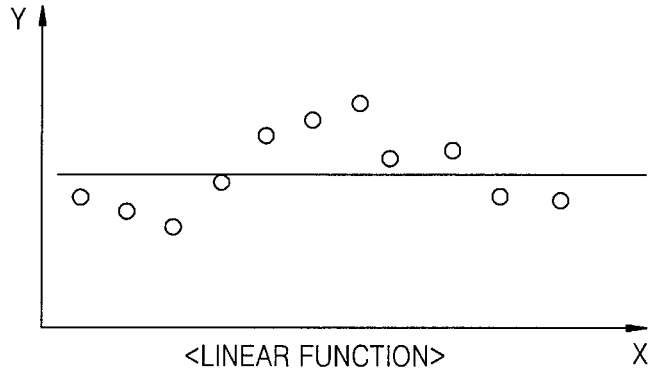
FIGS. 4A through 4C are graphs showing the brightness data modeled to a form of an Nth order function.
Figure 4B:
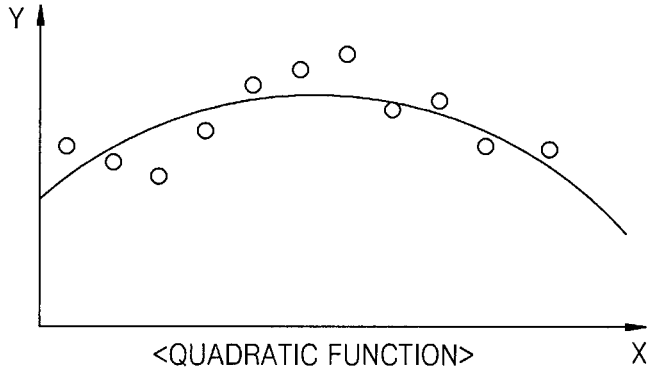
Figure 4C:
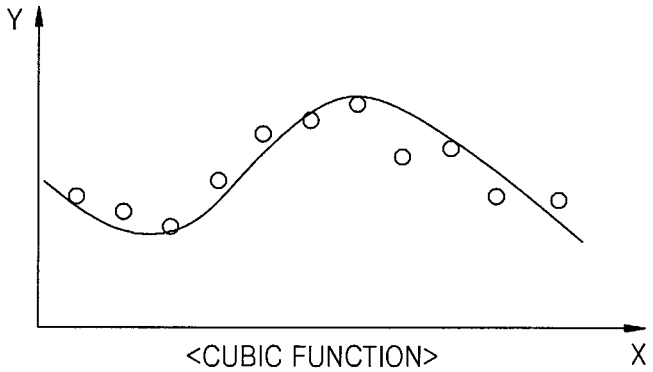

FIGS. 3 and 4A through 4C are diagrams for describing a method of obtaining a distribution of brightness data of the display panel 110 illustrated in FIG. 1, and modeling the distribution of the brightness data to the form of a function. FIG. 3 is a diagram showing the distribution of the brightness data. FIGS. 4A through 4C are graphs showing the brightness data modeled to the form of an Nth order function.

As illustrated in FIG. 3, the distribution of the brightness data (i.e., a brightness distribution) may be represented with locations and brightness values for a plurality of pixels aligned in one direction of the display panel 110 (e.g., an x direction, a y direction, or a z direction). In this case, the brightness value may be a brightness value of a single pixel or may be an average of brightness values of a plurality of pixels. For example, if a brightness trend line is calculated based on the brightness distribution of the whole display panel 110 in the x direction, a brightness value of each location on the brightness distribution may be an average of brightness values of pixels aligned in the y direction. In another embodiment, if the brightness trend line is calculated based on the brightness distribution of the whole display panel 110 in the y direction, a brightness value of each location on the brightness distribution may be an average of brightness values of pixels aligned in the x direction. In still another embodiment, if the brightness trend line is detected in units of a line on the display panel 110 (e.g., based on the brightness distribution of each line in the x direction or the y direction), a brightness value of each location on the brightness distribution may be a brightness value of each pixel included in the same line.

Referring to FIGS. 4A through 4C, the brightness distribution may be modeled to a form of a linear, quadratic, or cubic function. In this case, X is a location on the display panel 110, and Y is a brightness value.

The brightness distribution may be modeled to the form of a line-shaped linear function as illustrated in FIG. 4A, an arc-shaped quadratic function as illustrated in FIG. 4B, or a wave-shaped cubic function as illustrated in FIG. 4C. Coefficients of the functions may be adjusted in such a way that the forms of the functions are similar to the brightness distribution. One of the modeled functions may be determined as the brightness trend line. In this case, the brightness trend line may be determined based on proximity to the brightness distribution, e.g., LRU or SRU. For example, if the LRU is considered, the form of the linear function illustrated in FIG. 4A may be selected. Alternatively, if the proximity to the brightness distribution is considered, the form of the cubic function illustrated in FIG. 4C may be selected. Although the brightness distribution is modeled to the forms of three functions in FIGS. 4A through 4C, embodiments of the present invention are not limited thereto. For example, the brightness distribution may be modeled to forms of a different (e.g., larger or smaller) number of functions.

Figure 5A:
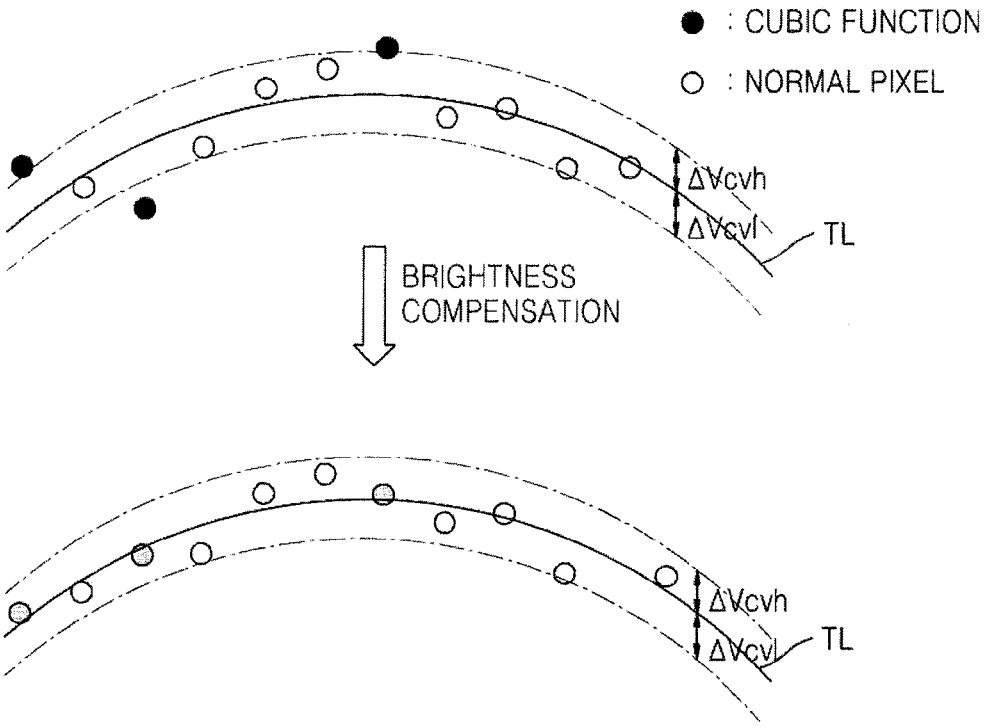
FIG. 5A is a diagram for describing brightness compensation performed based on a brightness trend line having a form of a quadratic function.
Figure 5B:
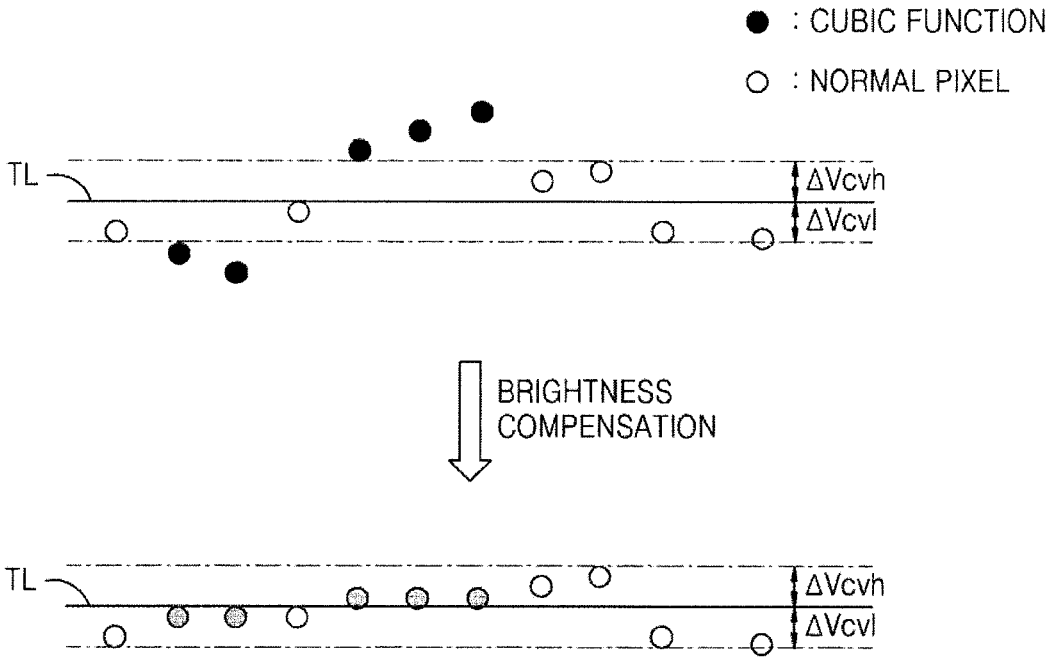
FIG. 5B is a diagram for describing brightness compensation performed based on a brightness trend line having a form of a linear function.

FIGS. 5A and 5B are diagrams for describing a method of detecting a defect pixel and performing brightness compensation. FIG. 5A is a diagram for describing a method of detecting a defect pixel based on a brightness trend line TL having a form of a quadratic function. FIG. 5B is a diagram for describing a method of detecting a defect pixel based on the brightness trend line TL having a form of a linear function.

Referring to FIGS. 5A and 5B, if a difference between a brightness value of one of a plurality of pixels and a brightness value of a location corresponding to the pixel on the brightness trend line TL is greater than a critical value ΔVcvh or ΔVcvl, the pixel is detected as a defect pixel. If the difference between the brightness value of the pixel and the brightness value of the location corresponding to the pixel on the brightness trend line TL is equal to or less than the critical value ΔVcvh or ΔVcvl, the pixel is detected as a non-defect pixel, i.e., a normal pixel. In this case, the critical value ΔVcvh or ΔVcvl may be set as a maximum value of a visually unrecognizable brightness difference based on the brightness trend line TL. Also, a positive critical value ΔVcvh and a negative critical value ΔVcvl may be differently set. The pixel detected as a defect pixel may be brightness-compensated to adjust its brightness value to be close to the brightness trend line TL.

Three pixels are detected as defect pixels in FIG. 5A, and five pixels are detected as defect pixels in FIG. 5B. Because the brightness trend line TL has different forms in FIGS. 5A and 5B, the number of pixels detected as defect pixels or the number of detected defect pixels may differ. Also, in FIG. 5A, the defect pixels detected based on the brightness trend line TL having the form of a quadratic function may be brightness-compensated to adjust its brightness value to be close to the brightness trend line TL having the form of a quadratic function. In FIG. 5B, the defect pixels detected based on the brightness trend line TL having the form of a linear function may be brightness-compensated to adjust its brightness value to be close to the brightness trend line TL having the form of a linear function.

Figure 6:
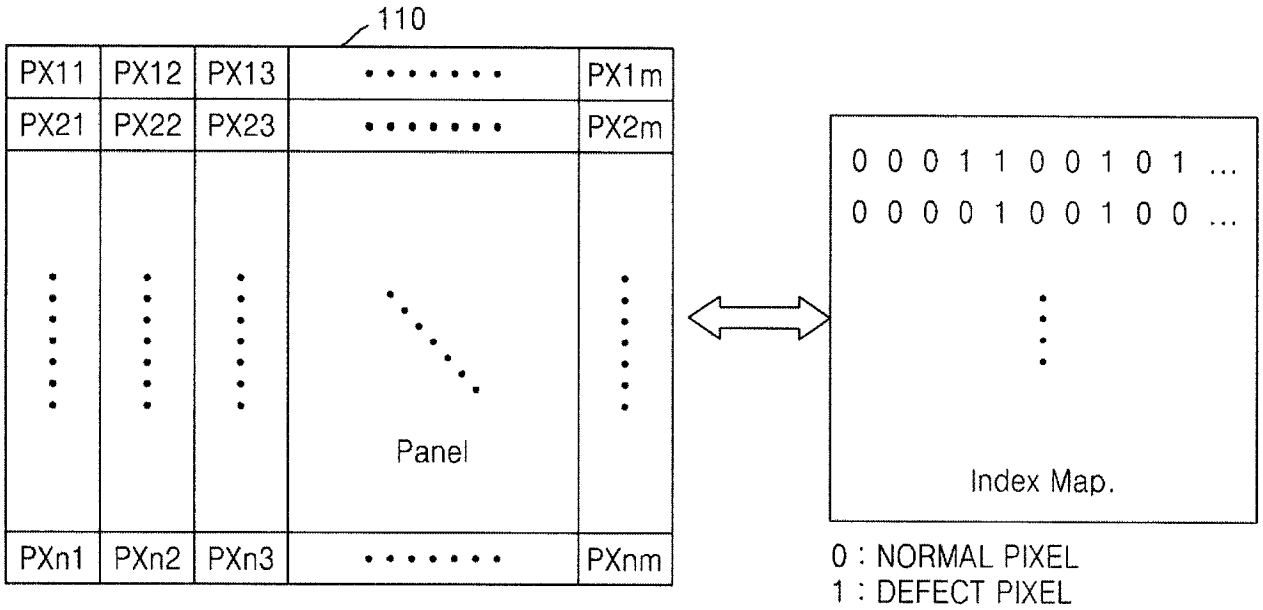
FIG. 6 is a diagram showing an index map obtained by indexing defect pixel information.

FIG. 6 is a diagram showing an index map obtained by indexing defect pixel information.

Referring to FIG. 6, defect pixel information representing whether each of a plurality of pixels PX11 through PXnm on the display panel 110 is a defect pixel or a normal pixel may be generated as an index map. The index map may include the same number of rows and the same number of columns as those of the display panel 110. A first index indicating a defect pixel and a second index indicating a non-defect pixel may be allocated to each of the pixels PX11 through PXnm of the display panel 110, and may be disposed at a row and column corresponding to a location of a corresponding pixel, thereby forming the index map. For example, the first index indicating a defect pixel may be a digital signal 1, and the second index indicating a non-defect pixel may be a digital signal 0. The index map may be stored in the display driving circuit 120, and pixels to be brightness-compensated may be determined based on the stored index map.

Figure 7A:
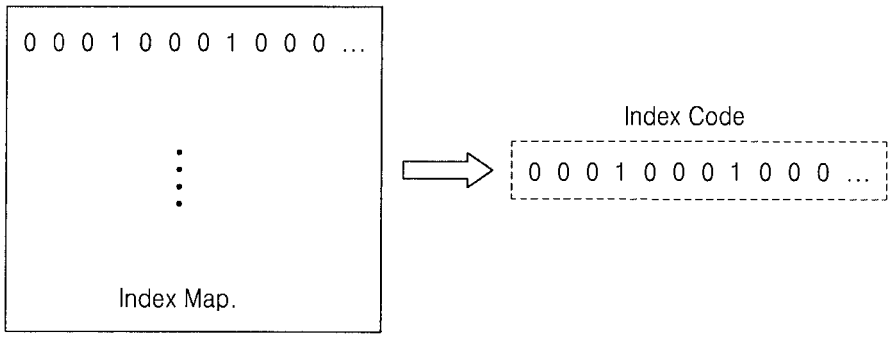
FIGS. 7A through 7C are diagrams showing data coding of the defect pixel information.
Figure 7B:
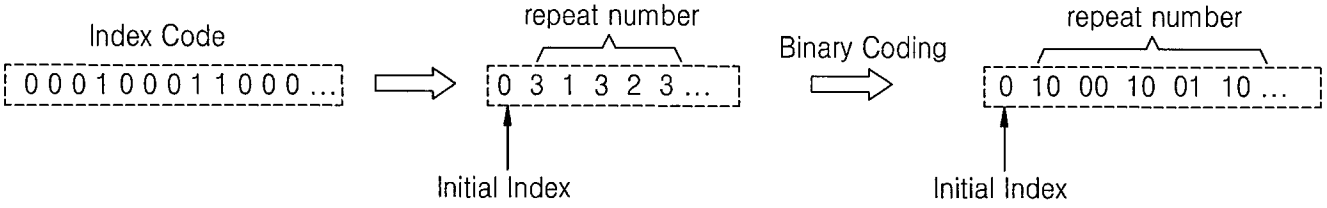
Figure 7C:
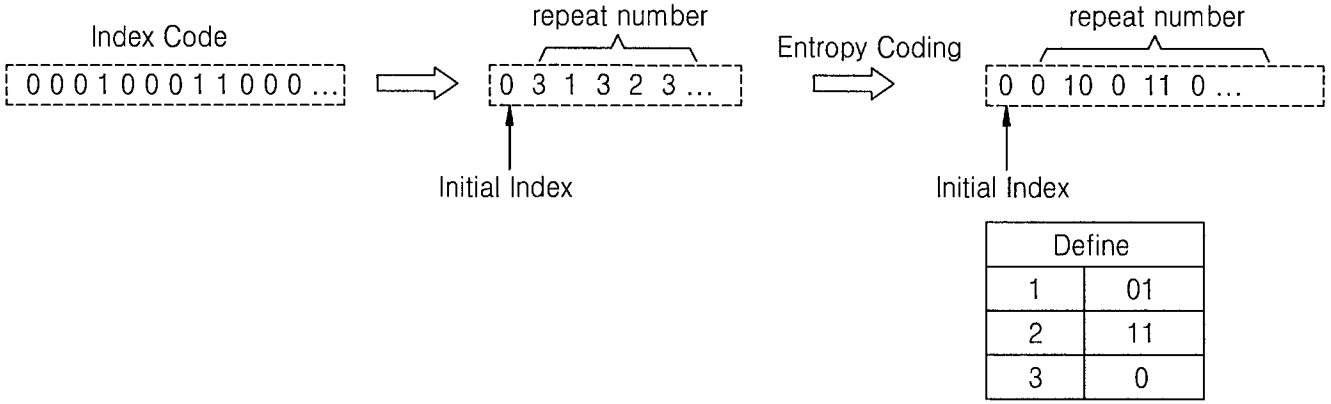

FIGS. 7A through 7C are diagrams showing data coding of the defect pixel information. The defect pixel information may be provided to the display device 100 illustrated in FIG. 1, and may be used to perform brightness compensation. In this case, the defect pixel information may be generated by using an index code (or a compressed index code may be provided to the display device 100), and may be stored in the display driving circuit 120. FIG. 7A shows that the defect pixel information is generated by using an index code, FIG. 7B shows that the index code is compressed by using binary coding, and FIG. 7C shows that the index code is compressed by using entropy coding.

Referring to FIG. 7A, the defect pixel information may be generated by using an index code in which first indices indicating defect pixels and second indices indicating non-defect pixels are sequentially aligned according to locations of corresponding pixels. The defect pixel information may be indexed, and thus, may be generated as an index map, and indices corresponding to first to last rows on the index map may be sequentially aligned to be generated as the index code.

Referring to FIGS. 7B and 7C, the index code may be compressed, for example, based on repeated numbers of the same indices. In this case, the repeated numbers of the same indices may be binary-coded as illustrated in FIG. 7B, or may be entropy-coded as illustrated in FIG. 7C. Based on the index code, an index of an initial pixel is displayed and then the repeated numbers of the same indices are displayed. For example, if the index code is "000100011000 . . . ", an index of an initial pixel is the second index (e.g., a digital signal 0), and the second index and the first index (which is different from the second index) are alternately repeated three times, one time, three times, two times, three times, . . . As such, the index code may be converted into '031323 . . . '.

In the example of FIG. 7B, first data 0 indicates the index of the initial pixel, and subsequent numbers of the index indicate the repeated numbers of the same indices. For example, as illustrated in FIG. 7B, the repeated numbers may be binary-coded. The repeated numbers may be converted into binary values, and thus, the index code may be compressed into "01000100110 . . . ".

In another embodiment, as illustrated in FIG. 7C, the repeated numbers may be entropy-coded. The repeated numbers may be binary-coded and, in this case, a smaller bit may be allocated to a more frequent repeated number of the same indices. Referring to FIG. 7C, a case when the same index is repeated three times occurs most frequently (two times), and a case when the same index is repeated one time and a case when the same index is repeated two times occur the same (one time). Accordingly, a digital signal 0 may be allocated to a repeated number 3, and digital signals "01" and "11" may be respectively allocated to repeated numbers 1 and 2. As such, the index code may be compressed into "00100110 . . . ". In FIGS. 7B and 7C, if the index code is compressed, when the compressed index code is provided to the display device 100, a header before the index code may be transmitted to indicate that the index code is compressed.

Figure 8:
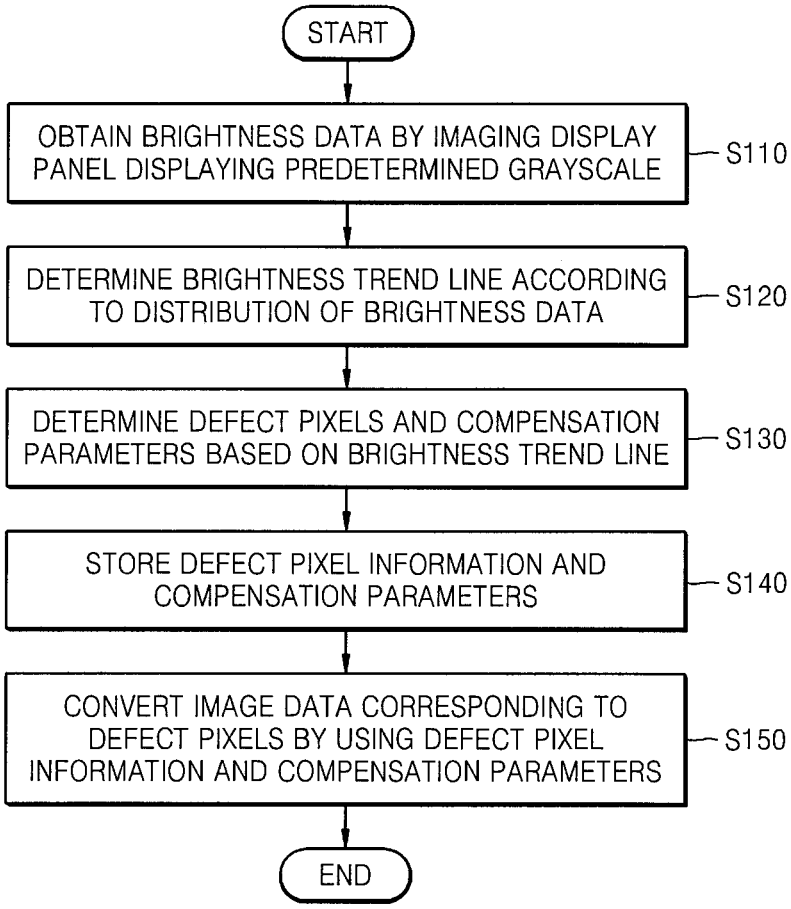
FIG. 8 is a flowchart of an optical compensation method according to an embodiment of the present invention.

FIG. 8 is a flowchart of an optical compensation method of an optical compensation system, according to an embodiment of the present invention;

Referring to FIG. 8, initially, brightness data is obtained by imaging the display panel 110 (which is illustrated in FIG. 1) while a predetermined grayscale is displayed (S110). The predetermined grayscale is displayed on the display panel 110, and the imaging unit 200 illustrated in FIG. 1 captures an image displayed on the display panel 110. The brightness data may be obtained by using the captured image.

A brightness trend line may then be determined according to a distribution of the brightness data (S120). According to one embodiment, the defect pixel detection unit 310 illustrated in FIG. 1 determines the brightness trend line of the display panel 110 by analyzing the brightness data. The brightness trend line may have a form of an Nth order function. In one embodiment, a plurality of brightness trend lines individually corresponding to lines of the display panel 110 may be determined. In another embodiment, one brightness trend line corresponding to the whole display panel 110 may be determined.

When the brightness trend line is determined, defect pixels and compensation parameters are determined based on the brightness trend line (S130). In one embodiment, a brightness difference in a visually unrecognizable range from the brightness trend line may be set as a critical value, and pixels having brightness differences greater than the critical value from the brightness trend line may be detected as defect pixels. After that, compensation parameters regarding the detected defect pixels are generated. The compensation parameters may be brightness compensation data individually corresponding to the defect pixels.

Then, according to one embodiment, defect pixel information and the compensation parameters are stored in the display device 100 illustrated in FIG. 1 (S140). The defect pixel information may be an index map or an index code where information regarding the defect pixels is indexed. The defect pixel information and the compensation parameters may be provided to the display device 100 and may be stored in a storage unit of the display device 100. In this case, the storage unit may be located in the display driving circuit 120 illustrated in FIG. 1. The defect pixel information and the compensation parameters may be stored in different storage regions. Also, the compensation parameters may be sequentially stored according to an order in which corresponding defect pixels are located.

The display driving circuit 120 converts image data corresponding to the defect pixels by using the stored defect pixel information and the compensation parameters (S150). As such, by converting the image data corresponding to the defect pixels, brightness values of the defect pixels may be compensated to be close to the brightness trend line.

Figure 9:
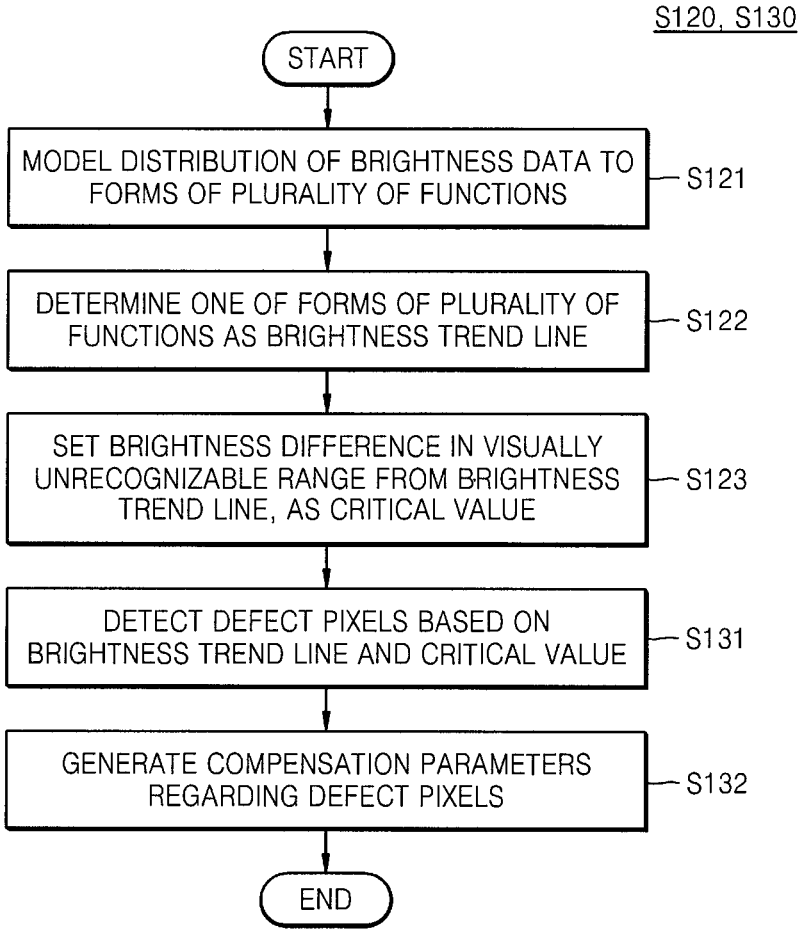
FIG. 9 is a flowchart of an example of an operation of determining a brightness trend line and an operation of determining defect pixel information and compensation parameters, in the method illustrated in FIG. 8.

FIG. 9 is a flowchart of an embodiment of the operation of determining a brightness trend line and the operation of determining defect pixel information and compensation parameters, in the method illustrated in FIG. 8.

Referring to FIG. 9, the defect pixel detection unit 310 illustrated in FIG. 1 models the distribution of the brightness data into forms of a plurality of functions (S121). For example, the distribution of the brightness data may be modeled to forms of a linear function through to an Nth order function. One of the forms of the plurality of functions is determined as a brightness trend line (S122). The brightness trend line may be determined in consideration of, for example, proximity to the distribution of the brightness data or uniformity of the display panel 110.

When the brightness trend line is determined, the defect pixel detection unit 310 sets a brightness difference in a visually unrecognizable range from the brightness trend line as a critical value (S123), and detects defect pixels based on the brightness trend line and the critical value (S131). Also, the compensation parameter generation unit 320 illustrated in FIG. 1 generates compensation parameters relating to the defect pixels detected by the defect pixel detection unit 310 (S132).

Figure 10:
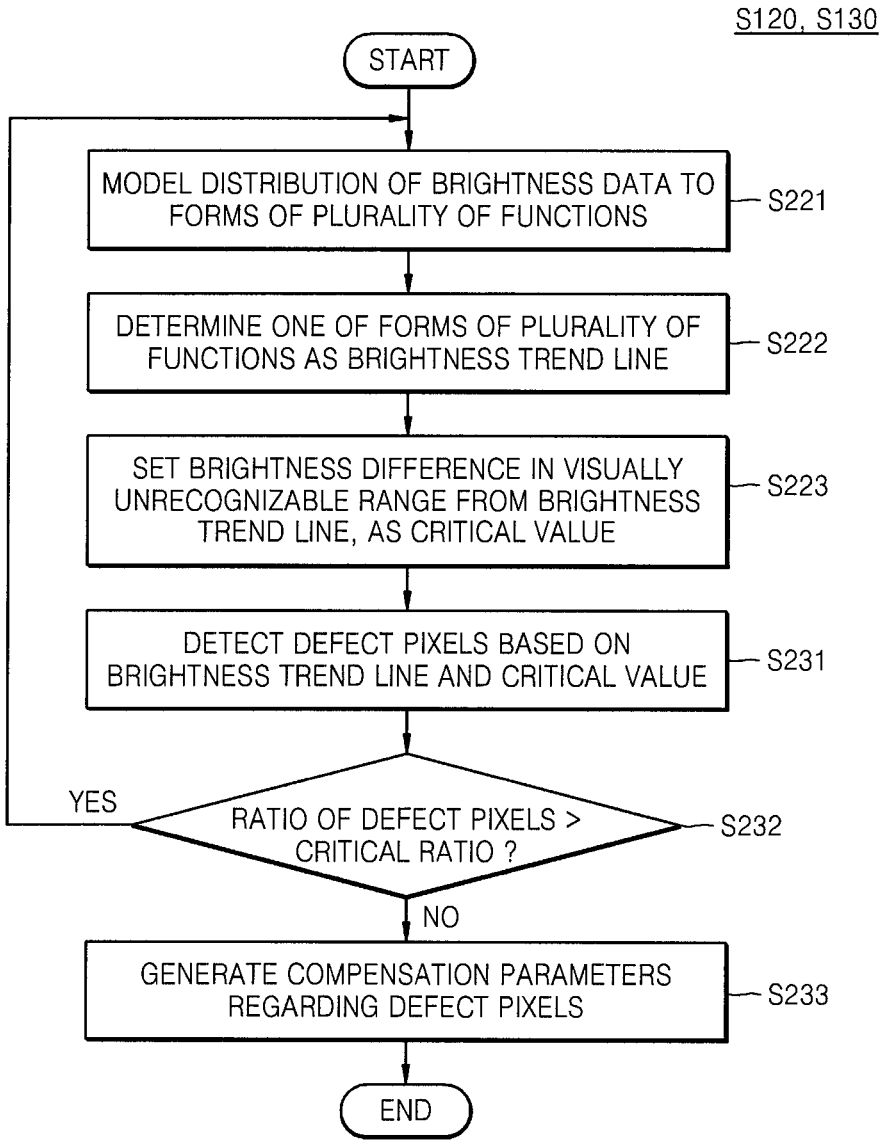
FIG. 10 is a flowchart of another example of operations of determining a brightness trend line and determining defect pixel information and compensation parameters, in the method illustrated in FIG. 8.

FIG. 10 is a flowchart of another embodiment of the operation of determining a brightness trend line and the operation of determining defect pixel information and compensation parameters, in the method illustrated in FIG. 8.

The flowchart of FIG. 10 is similar to the flowchart of FIG. 9. However, in FIG. 10, an operation of determining an appropriateness of the brightness trend line based on the number of detected defect pixels (S232) may be further included.

Referring to FIG. 10, the distribution of the brightness data is modeled to the forms of a plurality of functions (S221), and one of the forms of the plurality of functions is determined as a brightness trend line (S222). The distribution of the brightness data may be modeled to the forms of a linear function through to an Nth order function, and one of the forms of the linear function through to the Nth order function is determined as a brightness trend line in consideration of, for example, proximity to the distribution of the brightness data or uniformity of the display panel 110. Then, a brightness difference in a visually unrecognizable range from the brightness trend line is set as a critical value (S223), and defect pixels are detected based on the brightness trend line and the critical value (S231). Pixels having brightness differences greater than the critical value from the brightness trend line may be detected as defect pixels.

After that, the defect pixel detection unit 310 illustrated in FIG. 1 determines whether a ratio of the detected defect pixels to a total number of pixels is greater than a predetermined critical ratio (S232). If the ratio of the defect pixels is greater than the predetermined critical ratio, it may be determined that the brightness trend line is not appropriate. For example, if the predetermined critical ratio is set as 30% and a ratio of the defect pixels detected based on the brightness trend line, i.e., the number of defect pixels, is greater than 30% to a total number of pixels, it may be determined that the brightness trend line is not appropriate and the operation of determining a brightness trend line (S221, S222, and S233) may be performed again to determine a new brightness trend line. As such, if the ratio of the detected defect pixels is not greater than the predetermined critical ratio, compensation parameters regarding the defect pixels may be generated (S233).

Figure 11:
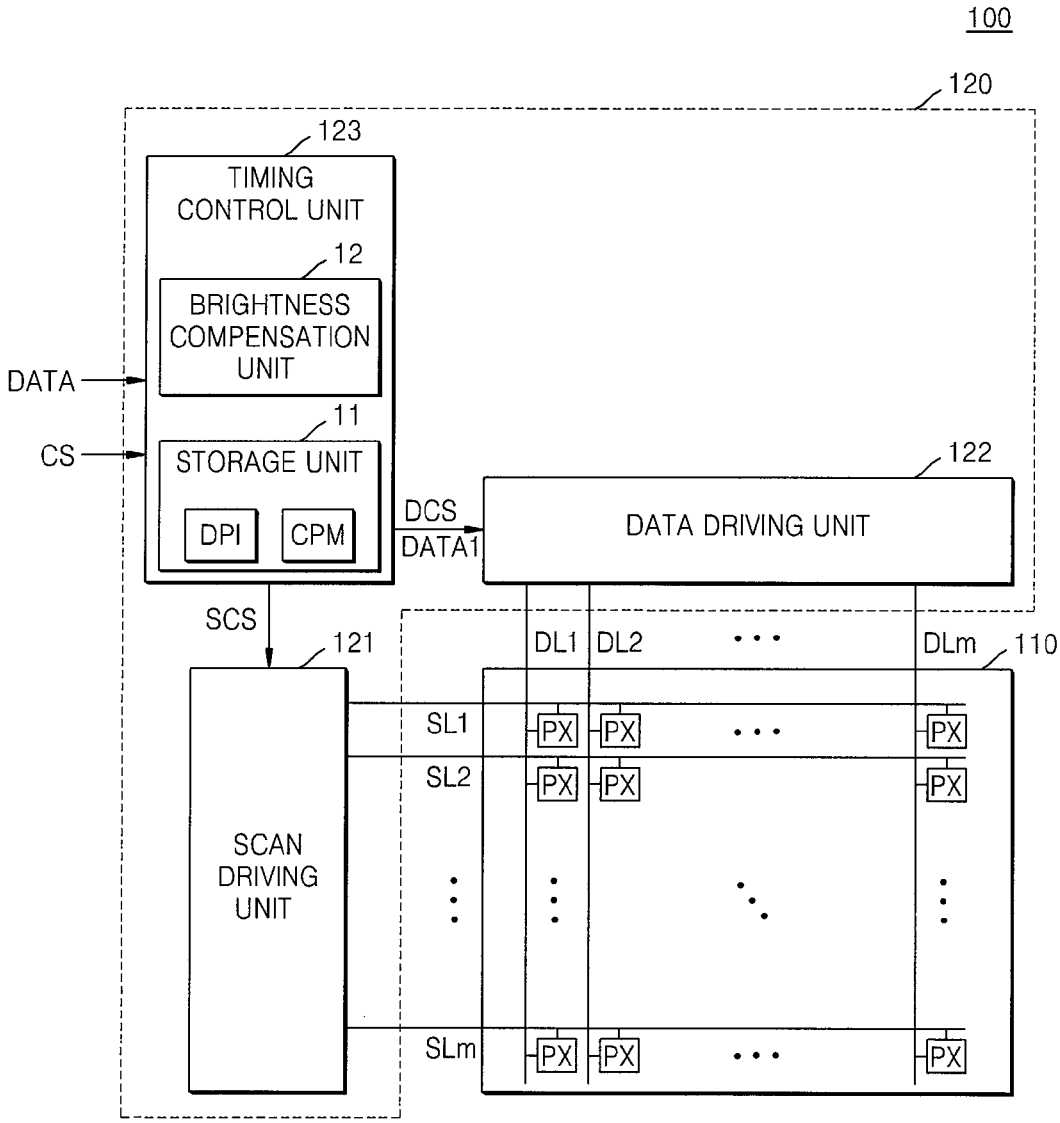
FIG. 11 is a block diagram of a display device according to an embodiment of the present invention.

FIG. 11 is a block diagram of a display device 100 according to an embodiment of the present invention.

Referring to FIG. 11, the display device 100 may include a display panel 110 for displaying an image and driving circuits 120 for driving the display panel 110.

The display device 100 may be one of various types of flat panel display devices. For example, the flat panel display devices may be an LCD device, a PDP, an OLED, an ECD device, a DMD, an AMD, a GLV device, or an ELD device.

The display panel 110 may include a plurality of scan lines SL1 through SLn for transmitting a scan signal in a row direction, a plurality of data lines DL1 through DLm aligned in a column direction, and a plurality of pixels PX aligned in a matrix at regions where the scan lines SL1 through SLn and the data lines DL1 through DLm cross each other.

The pixels PX may operate by receiving a scan signal and a data signal respectively from the scan lines SL1 through SLn and the data lines DL1 through DLm.

The driving circuits 120 may include a scan driving unit 121, a data driving unit 122, and a timing control unit 123. The driving circuits 120 may be formed on separate semiconductor chips or may be integrated together on one semiconductor chip. The scan driving unit 121 and the display panel 110 may be formed on the same substrate.

The scan driving unit 121, according to one embodiment, generates a scan signal by receiving a scan control signal SCS from the timing control unit 123. The scan driving unit 121 may supply the generated scan signal via the scan lines SL1 through SLn to the pixels PX. Due to the scan signal, a row of the pixels PX may be sequentially selected and a data signal may be provided thereto.

The data driving unit 122, according to one embodiment, receives a data control signal DCS and image data DATA1 from the timing control unit 123, and converts the image data DATA1 to a data signal in the form of a voltage or current in response to the data control signal DCS so as to supply the data signal via a corresponding one of the data lines DL1 through DLm to the pixels PX.

The timing control unit 123, according to one embodiment, generates the scan control signal SCS and the data control signal DCS for respectively controlling the scan driving unit 121 and the data driving unit 122 based on image data DATA and a control signal CS transmitted from an external device, and provides them respectively to the scan driving unit 121 and the data driving unit 122. The timing control unit 123 may image-process the image data DATA received from the external device into the image data DATA1 and may provide it to the data driving unit 122.

The display device 100 may prevent generation of a mura defect by performing brightness compensation according to characteristics of each of a plurality of pixels. Accordingly, in one embodiment, the timing control unit 123 includes a storage unit 11 for storing defect pixel information DPI indicating pixels detected as defect pixels from among a plurality of pixels based on a brightness trend line of the plurality of pixels, and compensation parameters CPM regarding the defect pixels, and includes a brightness compensation unit 12 for converting image data corresponding to the defect pixels by using the defect pixel information DPI and the compensation parameters CPM.

According to one embodiment, the storage unit 11 stores the defect pixel information DPI and the compensation parameters CPM provided from the compensation data generation unit 300 illustrated in FIG. 1. The storage unit 11 may be non-volatile memory. For example, the storage unit 11 may be one time programmable read-only memory (OTPROM), flash memory, erasable programmable read-only memory (EPROM), magnetic random access memory (MRAM), or resistive random access memory (RRAM).

The brightness compensation unit 12 performs brightness compensation on the defect pixels by using the defect pixel information DPI and the compensation parameters CPM. When the display device 100 is driven, the defect pixel information DPI and the compensation parameters CPM stored in the storage unit 11 may be loaded to the brightness compensation unit 12 and may be used to perform brightness compensation. The brightness compensation unit 12 may determine defect pixels based on the defect pixel information DPI, and may convert the image data DATA corresponding to the defect pixels by applying the compensation parameters CPM to the image data DATA. An image data conversion method according to one embodiment will now be described in detail with reference to FIGS. 12 and 13.

Figure 12:
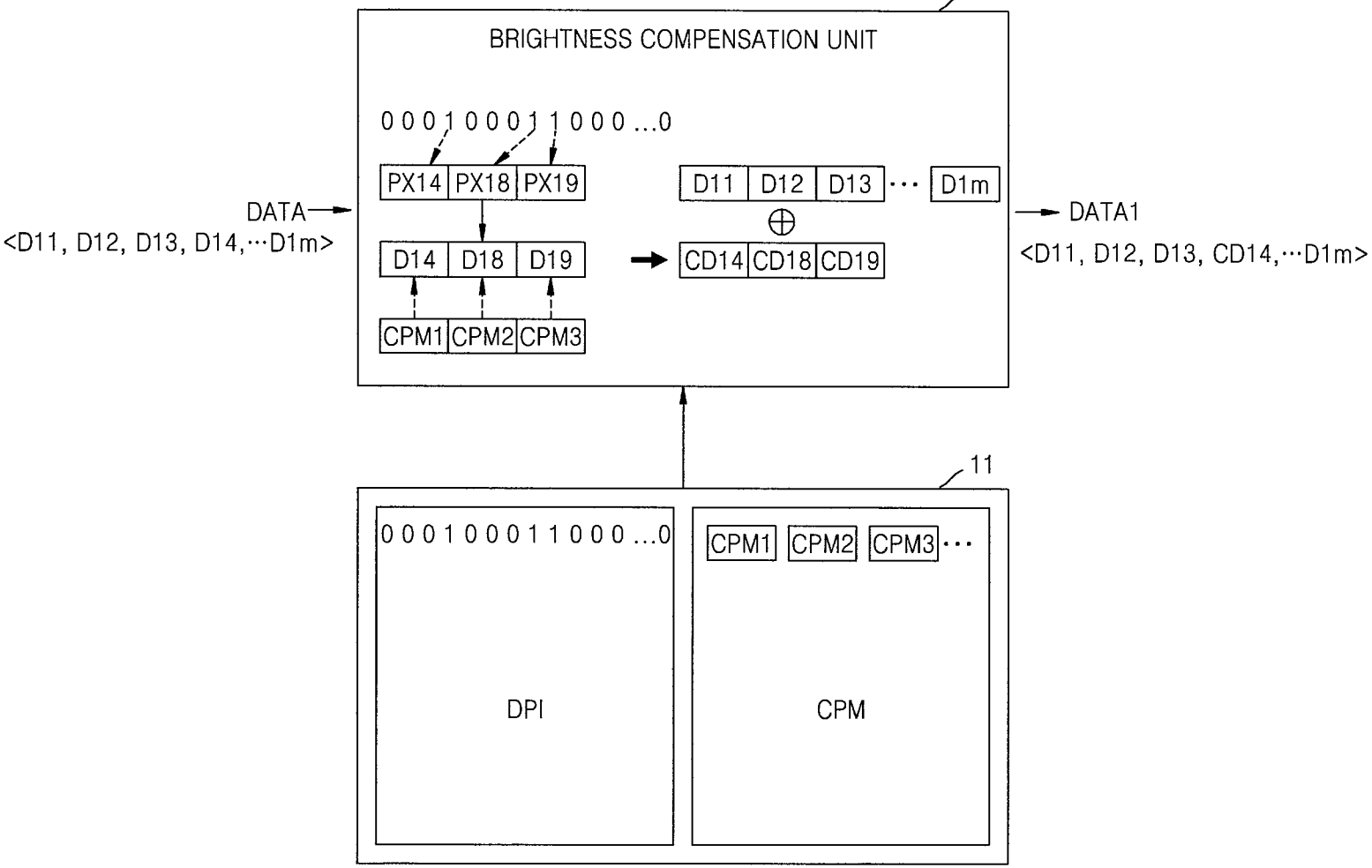
FIG. 12 is a block diagram of a brightness compensation unit and a storage unit of the display device illustrated in FIG. 11.
Figure 13:
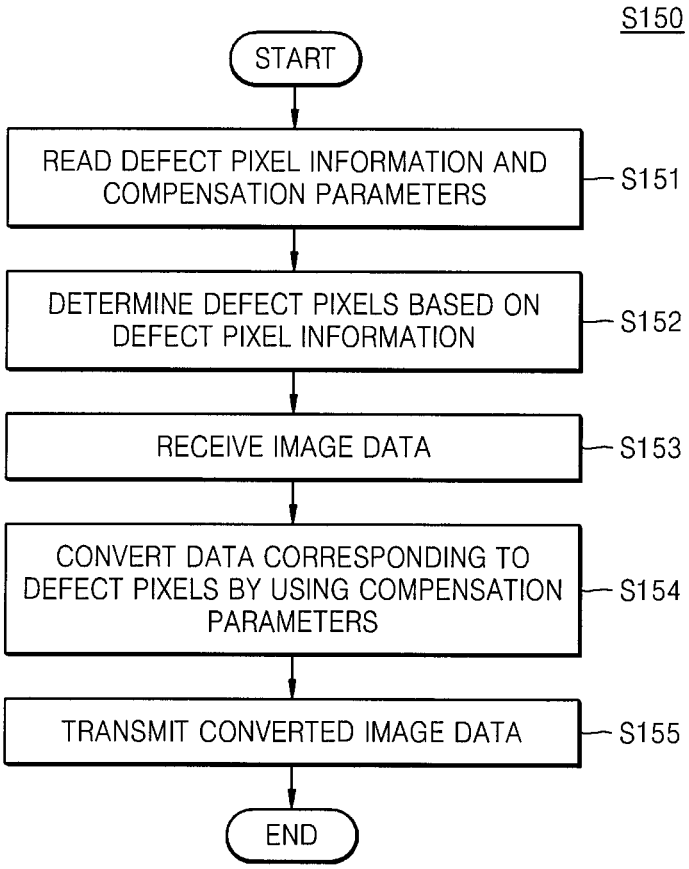
FIG. 13 is a flowchart of an operation of converting image data of the display device illustrated in FIG. 11.

FIG. 12 is a block diagram of the storage unit 11 and the brightness compensation unit 12 of the display device 100 illustrated in FIG. 11. FIG. 13 is a flowchart of an operation of converting image data DATA in the display device 100 illustrated in FIG. 11.

The brightness compensation unit 12 reads defect pixel information DPI and compensation parameters CPM stored in the storage unit 11 (S151). When the display panel 110 is driven, the defect pixel information DPI and the compensation parameters CPM may be loaded to the brightness compensation unit 12.

The brightness compensation unit 12 determines defect pixels that require brightness compensation based on the defect pixel information DPI (S152). For example, if the defect pixel information DPI is an index code of "000100011000 . . . ", it may be determined based on the index code that fourth, eighth, and ninth pixels PX14, PX18, and PX19 of a first row are defect pixels. If the defect pixel information DPI is compressed, an operation of decompressing it to an index code or an index map may be further included.

The brightness compensation unit 12 receives the image data DATA (S153), and converts data corresponding to the defect pixels by using the compensation parameters CPM (S154). For example, the display panel 110 may receive data D11 through D1m corresponding to one row, and compensation parameters CPM1, CPM2, and CPM3 may be sequentially applied to the data D14, D18, and D19 corresponding to the defect pixels PX14, PX18, and PX19 so as to perform data conversion.

If the defect pixels are data-converted, the brightness compensation unit 12 transmits converted image data DATA1 (S155). The converted image data DATA1 may include converted data CD14, CD18, and CD19 corresponding to the defect pixels and the data D11, D12, D13, D15 through D17, and D20 through D1m corresponding to normal pixels. The converted image data DATA1 is transmitted to the data driving unit 122 illustrated in FIG. 11. By providing to the display panel 110 a grayscale voltage corresponding to the converted image data DATA1 and obtained by performing brightness compensation on the defect pixels, occurrence of a mura defect on the display panel 110 may be prevented.

According to one embodiment, because brightness compensation is performed only on defect pixels of the display panel 110, power consumption of the display device 100 may be reduced. Also, when information regarding pixels detected as defect pixels is indexed and optical compensation parameters are generated with regard to only the pixels determined as defect pixels, a space for storing defect pixel information and compensation parameters in the display device 100 may be reduced.

In an optical compensation system according an aspect of the present invention, defect pixels may be efficiently detected and compensated according to brightness characteristics of the display panel.

The present invention has been particularly shown and described with reference to exemplary embodiments thereof. Terms used herein to describe the invention are for descriptive purposes only and are not intended to limit the scope of the present invention. Accordingly, it will be understood by those of ordinary skill in the art that various changes in form and details may be made therein without departing from the spirit and scope of the present invention as defined by the following claims and their equivalents.

What is claimed is:

1. A display device comprising:

a display panel comprising a plurality of pixels; and a display driving circuit for driving the display panel and comprising:

a storage unit for storing defect pixel information indicating which pixels from among the plurality of pixels are detected as defect pixels based on a brightness trend line of the plurality of pixels, and for storing compensation parameters regarding the defect pixels, wherein the brightness trend line is determined by modeling a distribution of brightness data to a form of an Nth order function (where N is an integer equal to or greater than 1) and determining an appropriateness of the form of the Nth order function based on a ratio of the defect pixels to a total number of the plurality of pixels before determining it as the brightness trend line; and a brightness compensation unit for converting image data corresponding to the defect pixels according to the defect pixel information and the compensation parameters.

2. The display device of claim 1, wherein a defect pixel of the defect pixels is a pixel in which a difference between a measured brightness value of the pixel and a brightness value of a location corresponding to the pixel on the brightness trend line is greater than a critical value.

3. The display device of claim 1, wherein the storage unit is configured to store the compensation parameters according to an order in which corresponding defect pixels are located.

4. The display device of claim 1, wherein the compensation parameters comprise brightness compensation data corresponding to the defect pixels, individually.

5. The display device of claim 1, wherein the brightness compensation unit is configured to determine whether or not each of the plurality of pixels is one of the defect pixels based on the defect pixel information, and to convert the image data corresponding to the defect pixels by applying the compensation parameters according to an order in which the compensation parameters are stored.

6. The display device of claim 1, wherein the defect pixel information comprises indices representing whether or not the plurality of pixels is one of the defect pixels, individually.

7. The display device of claim 1, wherein the defect pixel information comprises an index code in which first indices indicating the defect pixels and second indices indicating non-defect pixels of the pixels are sequentially aligned according to locations of corresponding pixels.

8. The display device of claim 7, wherein the index code is compressed based on repeated numbers of the same indices.

9. The display device of claim 7, wherein, in the index code, a smaller bit is allocated to a more frequently repeated number of the same indices.

10. An optical compensation system for preventing non-uniform brightness values of a display panel, the optical compensation system comprising:

the display panel for displaying an image, the display panel comprising a plurality of pixels;

an imaging unit for capturing the image displayed on the display panel;

a defect pixel detection unit for generating a brightness trend line of the display panel by analyzing brightness data obtained by using the image captured by the imaging unit, and for detecting defect pixels based on the brightness trend line, wherein the brightness trend line is determined by modeling a distribution of the brightness data to a form of an Nth order function (where N is an integer equal to or greater than 1) and determining an appropriateness of the form of the Nth order function based on a ratio of the defect pixels to a total number of the plurality of pixels before determining it as the brightness trend line; and a compensation parameter generation unit for generating compensation parameters for compensating for brightness values of the defect pixels.

11. The optical compensation system of claim 10, wherein the brightness trend line has the form of an Nth order function (where N is an integer equal to or greater than 1) on a first axis indicating one direction on the display panel and a second axis indicating brightness values.

12. The optical compensation system of claim 10, wherein the defect pixel detection unit is configured to calculate the brightness trend line based on the brightness data of the pixels located on a same line of the display panel.

13. The optical compensation system of claim 10, wherein the defect pixel detection unit is configured to calculate the ratio of the defect pixels to the total number of the plurality of pixels is equal to or less than a predetermined ratio.

14. An optical compensation method comprising:

obtaining brightness data of a display panel comprising a plurality of pixels;

modeling a distribution of the brightness data to a form of an Nth order function (where N is an integer equal to or greater than 1); and determining an appropriateness of the form of the Nth order function based on a ratio of defect pixels to a total number of the plurality of pixels;

determining an appropriate form of the Nth order function as a brightness trend line of the display panel;

determining defect pixels of the plurality of pixels and compensation parameters based on the brightness trend line; and storing defect pixel information and the compensation parameters in a storage unit of a display driving circuit.

15. The optical compensation method of claim 14, wherein the determining of the defect pixels and the compensation parameters comprises detecting a pixel of the plurality of pixels as one of the defect pixels if a difference between a measured brightness value of the pixel and a brightness value of a location corresponding to the pixel on the brightness trend line is greater than a critical value.

16. The optical compensation method of claim 14, wherein the determining of the defect pixels and the compensation parameters comprises generating the compensation parameters based on a difference between measured brightness values of the defect pixels and brightness values of locations corresponding to the defect pixels on the brightness trend line.

17. The optical compensation method of claim 14, wherein the storing of the defect pixel information and the compensation parameters comprises:

providing pixel indices individually representing whether the plurality of pixels are defect pixels; and generating the defect pixel information based on the pixel indices individually provided to the plurality of pixels.

18. The optical compensation method of claim 14, further comprising converting image data to be displayed on the display panel and corresponding to the defect pixels according to the defect pixel information and the compensation parameters.

* * * * *